US008063328B2

(12) United States Patent
Gottschalk et al.

(10) Patent No.: US 8,063,328 B2
(45) Date of Patent: Nov. 22, 2011

(54) ELECTRICAL SWITCHING APPARATUS AND CHARGING ASSEMBLY THEREFOR

(75) Inventors: Andrew L. Gottschalk, Pittsburgh, PA (US); Robert Michael Slepian, Murrysville, PA (US)

(73) Assignee: Eaton Corporation, Cleveland, OH (US)

( * ) Notice: Subject to any disclaimer, the term of this patent is extended or adjusted under 35 U.S.C. 154(b) by 279 days.

(21) Appl. No.: 12/560,703

(22) Filed: Sep. 16, 2009

(65) Prior Publication Data

US 2011/0062005 A1 Mar. 17, 2011

(51) Int. Cl.
*H01H 5/00* (2006.01)

(52) U.S. Cl. ..... 200/400

(58) Field of Classification Search ..... 200/400, 200/401, 330, 331, 17 R, 337, 323–325
See application file for complete search history.

(56) References Cited

U.S. PATENT DOCUMENTS

| | | | | |
|---|---|---|---|---|
| 4,219,713 | A | 8/1980 | Maier et al. | |
| 4,821,008 | A * | 4/1989 | Micoud et al. | 335/189 |
| 5,224,590 | A | 7/1993 | Milianowicz et al. | |
| 5,571,255 | A * | 11/1996 | Baginski et al. | 200/401 |
| 6,362,442 | B1 | 3/2002 | Engel et al. | |
| 6,437,269 | B1 * | 8/2002 | Rakus | 200/400 |
| 6,472,627 | B1 | 10/2002 | Yoon | |
| 6,515,245 | B2 * | 2/2003 | Marin-Pache et al. | 200/400 |
| 6,870,113 | B2 | 3/2005 | Dahl et al. | |
| 7,038,155 | B2 | 5/2006 | Ahlert et al. | |
| 7,294,804 | B1 * | 11/2007 | Gottschalk et al. | 200/400 |
| 7,368,677 | B2 * | 5/2008 | Jones et al. | 200/400 |
| 7,449,652 | B2 | 11/2008 | Rakus et al. | |
| 7,449,653 | B2 | 11/2008 | Gibson et al. | |
| 7,459,650 | B2 * | 12/2008 | Weister et al. | 200/400 |
| 7,687,733 | B2 * | 3/2010 | Weister et al. | 200/400 |
| 7,696,448 | B2 * | 4/2010 | Rakus et al. | 200/400 |
| 7,902,472 | B2 * | 3/2011 | Godesa | 200/400 |
| 7,956,307 | B2 * | 6/2011 | Ahn | 218/154 |
| 2008/0237014 | A1 | 10/2008 | Wehrli, III et al. | |

* cited by examiner

*Primary Examiner* — Michael Friedhofer
(74) *Attorney, Agent, or Firm* — Martin J. Moran

(57) ABSTRACT

A charging assembly is provided for an electrical switching apparatus, such as a circuit breaker. The charging assembly includes a compression arm and a charging cam. The compression arm includes a pivot and first and second legs extending outwardly from the pivot, preferably in a generally L-shape. An engagement portion disposed at or about a second end of the first leg cooperates with an outer cam surface of the charging cam. A shaped contact surface disposed at or about a second end of the second leg includes a first edge for engaging and moving an impact member of the circuit breaker closing assembly to charge a biasing element of the closing assembly, and a second edge. The second edge is disposed at an angle with respect to the first edge, and is structured to engage the impact member when the biasing element is disposed in the charged position.

20 Claims, 5 Drawing Sheets

ELECTRICAL SWITCHING APPARATUS AND CHARGING ASSEMBLY THEREFOR

CROSS-REFERENCE TO RELATED APPLICATION

This application is related to commonly assigned, concurrently filed:

U.S. patent application Ser. No. 12/560,807, filed Sep. 16, 2009, entitled "ELECTRICAL SWITCHING APPARATUS AND LINKING ASSEMBLY THEREFOR".

BACKGROUND

1. Field

The disclosed concept relates generally to electrical switching apparatus and, more particularly, to electrical switching apparatus, such as circuit breakers. The disclosed concept also relates to charging assemblies for electrical switching apparatus.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions as detected, for example, by a trip unit.

Some low and medium voltage circuit breakers, for example, further employ a spring-operated stored energy assembly. Specifically, the operating mechanism of such circuit breakers typically includes an opening assembly having at least one spring, which facilitates the opening (e.g., separation) of the electrical contact assemblies, a closing assembly including a number of springs that close the electrical contact assemblies, and a charging mechanism for charging the spring(s). The contact assemblies are closed by releasing the stored energy of the closing assembly spring(s). The spring(s) is/are charged by a charging assembly which is operated manually, using a manual charging mechanism such as, for example, a charging handle, and/or automatically using a motor-driven charging mechanism or other suitable electromechanical charging mechanism.

FIGS. 1A-1D show one non-limiting example of a circuit breaker 1 (partially shown) having a spring charging assembly 9 for charging a number of closing springs 11 (one is shown in the side elevation view of FIGS. 1A-1D). The spring charging assembly 9 includes a charging cam 13 and a compression arm 15, which cooperates with the charging cam 13 to compress and thereby charge the closing spring 11 (see FIG. 1A). The compression arm 15 pivots (e.g., counterclockwise from the perspective of FIGS. 1A-1D) in response to the contact force applied to it by the closing spring 11. Thus, by virtue of the design (e.g., without limitation, shape) of the compression arm 15 and/or the charging cam 13, the closing spring 11 has the effect of producing a relatively significant amount of torque on the compression arm 15. Consequently, interaction of the compression arm 15 with relatively small changes in the curvature of the charging cam 13 undesirably results in relatively large changes in torque. As such, very close control must be kept of the precise shape of the charging cam 13 to control movement of the spring charging assembly 9 and ultimately, the latch load (e.g., the force applied by the closing spring 11 to the linking assembly 5 of the spring charging assembly 9).

Among other disadvantages, the requirement for such close control of the charge cam geometry increases the cost to manufacture the spring charging assembly 9 and, in particular the charging cam 13 therefor, and decreases the robustness of the overall design because certain components (e.g., without limitation, charging cam 13; compression arm 15) are exposed to considerable force during operation, which undesirably increases wear and tear.

There is, therefore, room for improvement in electrical switching apparatus, such as circuit breakers, and in charging assemblies therefor.

SUMMARY

These needs and others are met by embodiments of the disclosed concept, which are directed to a charging assembly for an electrical switching apparatus, such as a circuit breaker. Among other benefits, the charging assembly includes a charging cam and compression arm which are structured to reduce undesirable torque on the assembly, thereby improving the robustness of the design.

As one aspect of the disclosed concept, a charging assembly is provided for an electrical switching apparatus. The electrical switching apparatus includes a housing, separable contacts enclosed by the housing, and an operating mechanism structured to move the separable contacts between an open position corresponding to the separable contacts being separated and a closed position corresponding to the separable contacts being electrically connected. The operating mechanism includes a linking assembly and a closing assembly. The closing assembly includes a biasing element and an impact member coupled to the biasing element. The biasing element is movable between a charged position and a discharged position. When the biasing element moves from the charged position to the discharged position, the impact member engages and moves the linking assembly thereby moving the separable contacts to the closed position. The charging assembly comprises: a compression arm including a pivot structured to pivotally couple the compression arm to the housing of the electrical switching apparatus, a first leg, and a second leg, each of the first leg and the second leg comprising a first end and a second end disposed opposite and distal from the first end, the first end of the first leg being disposed at or about the pivot, the second end of the first leg extending outwardly from the pivot in a first direction, the first end of the second leg being disposed at or about the pivot, the second end of the second leg extending outwardly from the pivot in a second direction; an engagement portion disposed at or about the second end of the first leg; a shaped contact surface disposed at or about the second end of the second leg, the shaped contact surface comprising a first edge and second edge disposed at an angle with respect to the first edge; and a charging cam structured to be pivotally coupled to the housing of the electrical switching apparatus, the charging cam including an outer cam surface structured to cooperate with the engagement portion of the first leg of the compression arm. When the charging cam pivots, the outer cam surface engages the engagement portion of the first leg, thereby pivoting the compression arm about the pivot. Responsive to the compression arm pivoting about the pivot, the first edge of the shaped contact surface of the second leg is structured to engage and move the impact member of the closing assembly, thereby moving the biasing element from the discharged position toward the charged position. When the biasing element is disposed in the charged position, the second edge of the shaped contact surface of the second leg is structured to engage the impact member.

The first leg may further comprise a first longitudinal axis extending from the pivot of the compression arm through the second end of the first leg in the first direction, and the second leg may further comprise a second longitudinal axis extending from the pivot of the compression arm through the second end of the second leg in the second direction. The first longitudinal axis may be disposed at an angle with respect to the second longitudinal axis of between about 80 degrees and about 110 degrees. The second leg of the compression arm may be disposed generally perpendicularly with respect to the first leg of the compression arm in order that the compression arm has a generally L-shape.

The outer cam surface of the charging cam may comprises a variable radius, wherein the variable radius comprises a point of minimum radius and a point of maximum radius. The variable radius may increase gradually from the point of minimum radius to the point of maximum radius. When the biasing element is disposed in the charged position, the point of maximum radius of the charging cam may be structured to be cooperable with the engagement portion of the first leg and, when the biasing element of the closing assembly is disposed in the discharged position, the point of minimum radius of the charging cam may be structured to cooperate with the engagement portion of the first leg of the compression arm. The outer cam surface of the charging cam may further comprise a transition point, and the variable radius may further comprise a first downslope and a second downslope, wherein the first downslope is disposed between the point of maximum radius and the transition point, and wherein the second downslope is disposed between the transition point and the point of minimum radius. The second downslope may be greater than the first downslope.

As another aspect of the disclosed concept, an electrical switching apparatus comprises: a housing; separable contacts enclosed by the housing; an operating mechanism structured to move the separable contacts between an open position corresponding to the separable contacts being separated and a closed position corresponding to the separable contacts being electrically connected; a linking assembly; a closing assembly including a biasing element and an impact member coupled to the biasing element, the biasing element being movable between a charged position and a discharged position, when the biasing element moves from the charged position to the discharged position, the impact member engages and moves the linking assembly thereby moving the separable contacts to the closed position; and a charging assembly comprising: a compression arm including a pivot pivotally coupling the compression arm to the housing, a first leg, and a second leg, each of the first leg and the second leg comprising a first end and a second end disposed opposite and distal from the first end, the first end of the first leg being disposed at or about the pivot, the second end of the first leg extending outwardly from the pivot in a first direction, the first end of the second leg being disposed at or about the pivot, the second end of the second leg extending outwardly from the pivot in a second direction, an engagement portion disposed at or about the second end of the first leg, a shaped contact surface disposed at or about the second end of the second leg, the shaped contact surface comprising a first edge and second edge disposed at an angle with respect to the first edge, and a charging cam pivotally coupled to the housing of the electrical switching apparatus, the charging cam including an outer cam surface cooperating with the engagement portion of the first leg of the compression arm. When the charging cam pivots, the outer cam surface engages the engagement portion of the first leg, thereby pivoting the compression arm about the pivot. Responsive to the compression arm pivoting about the pivot, the first edge of the shaped contact surface of the second leg engages and moves the impact member of the closing assembly, thereby moving the biasing element from the discharged position toward the charged position. When the biasing element is disposed in the charged position, the second edge of the shaped contact surface of the second leg engages the impact member.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1A:
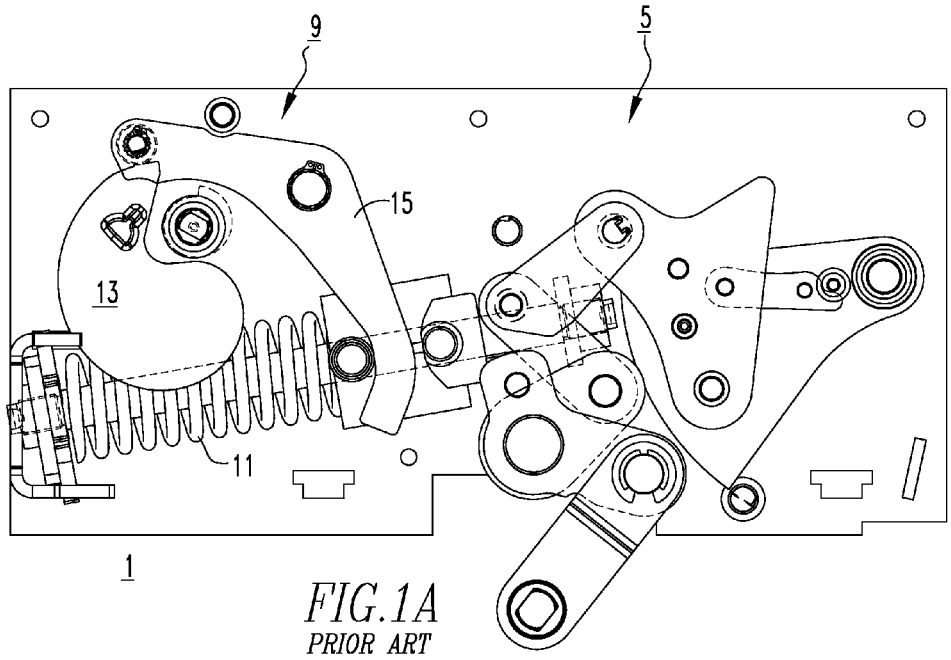
FIG.1A PRIOR ART
FIG. 1A is a side elevation view of a spring charging assembly for a circuit breaker, showing the spring charging assembly in the charged and open position.

Directional phrases used herein, such as, for example, left, right, clockwise, counterclockwise and derivatives thereof, relate to the orientation of the elements shown in the drawings and are not limiting upon the claims unless expressly recited therein.

As employed herein, the term "biasing element" refers to refers to any known or suitable stored energy mechanism such as, for example and without limitation, springs and cylinders (e.g., without limitation, hydraulic cylinders; pneumatic cylinders).

As employed herein, the term "downslope" refers to the decreasing radius of the outer cam surface of the disclosed charging cam upon movement from one predetermined location on the outer cam surface (e.g., without limitation, the point of maximum radius) to another predetermined location on the outer cam surface (e.g., without limitation, the transition point).

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2A:
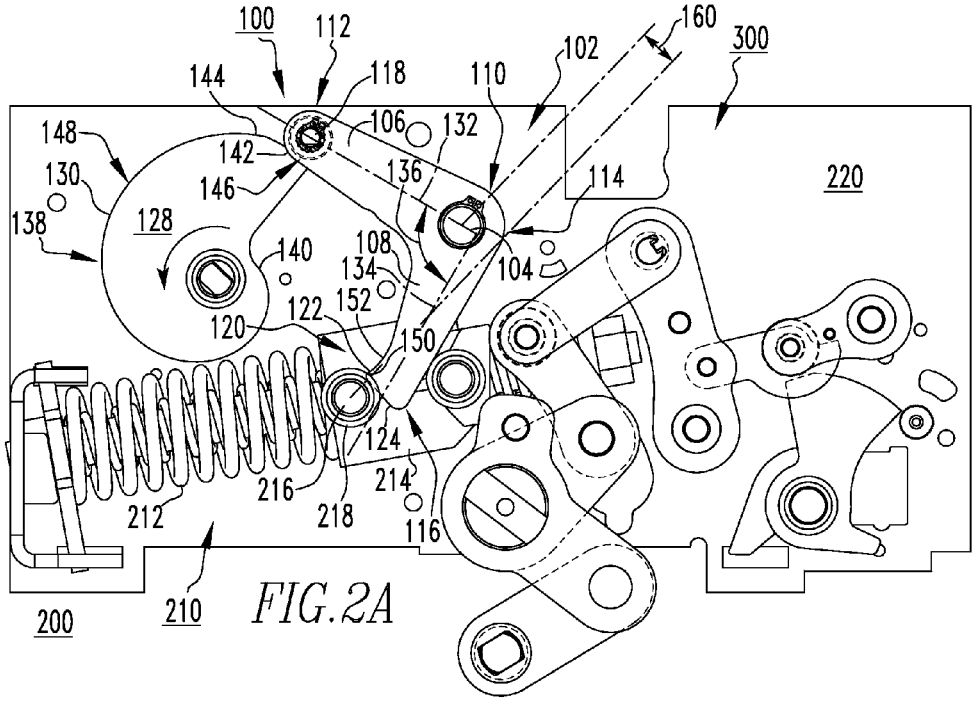
FIG. 2A is a side elevation view of a charging assembly in accordance with an embodiment of the disclosed concept, showing the charging assembly in the charged and open position.
Figure 2B:
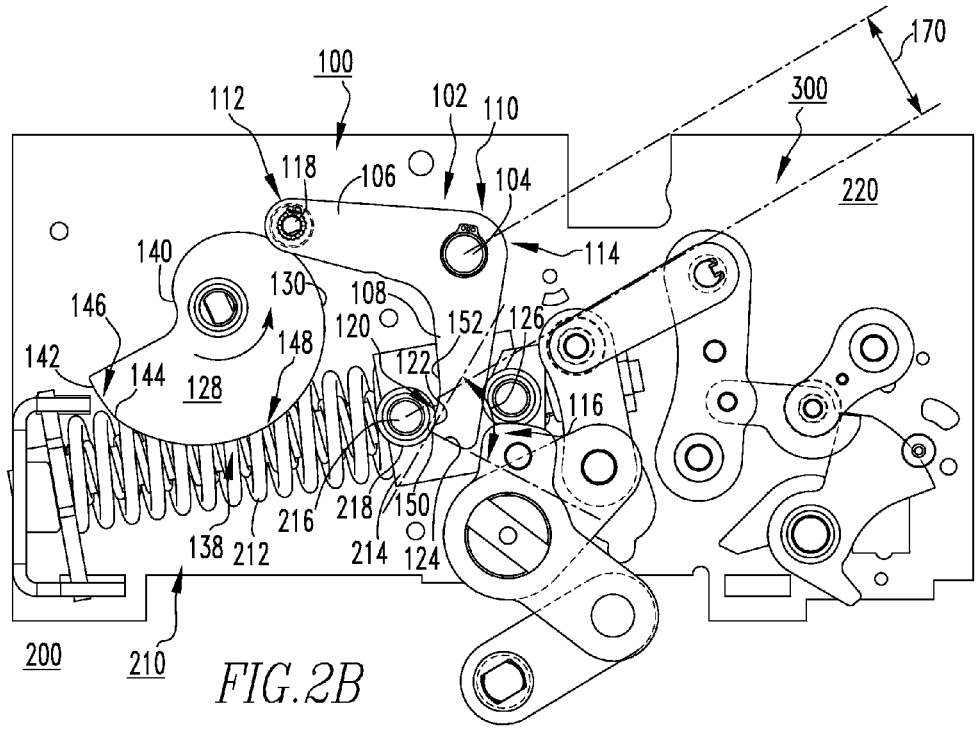
FIG. 2B is a side elevation view of the charging assembly of FIG. 2A, modified to show the charging assembly in the open and partially charged position.
Figure 2C:
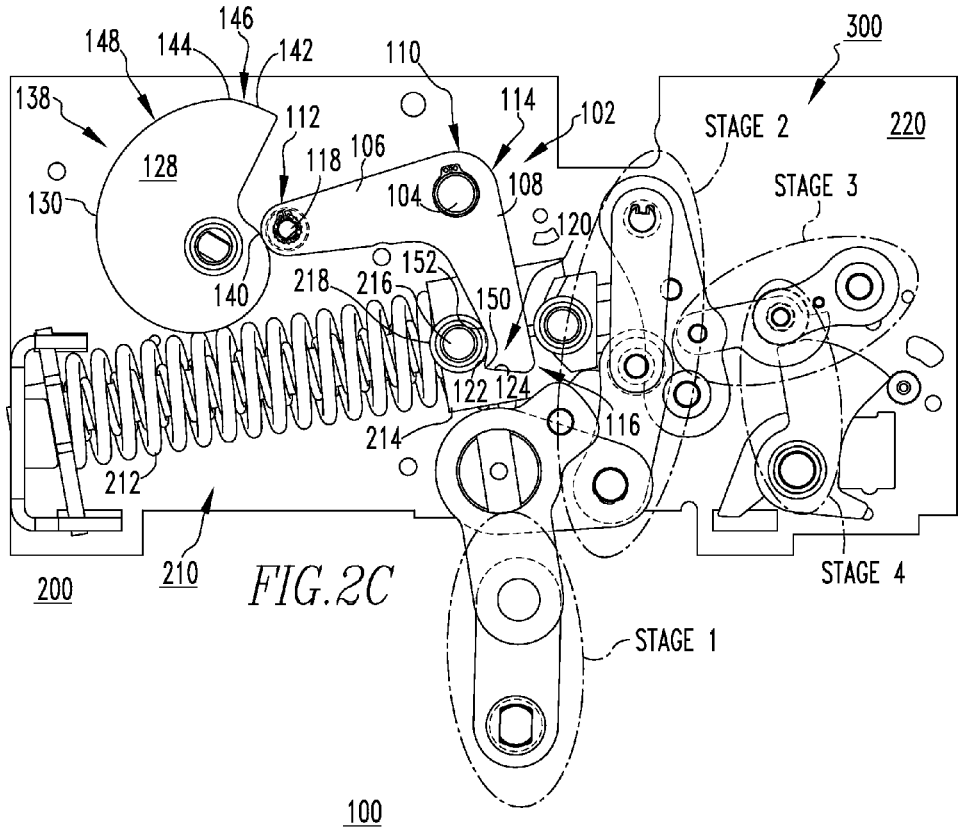
FIG. 2C is a side elevation view of the charging assembly of FIG. 2A, modified to show the charging assembly in the discharged and closed position.
Figure 2D:
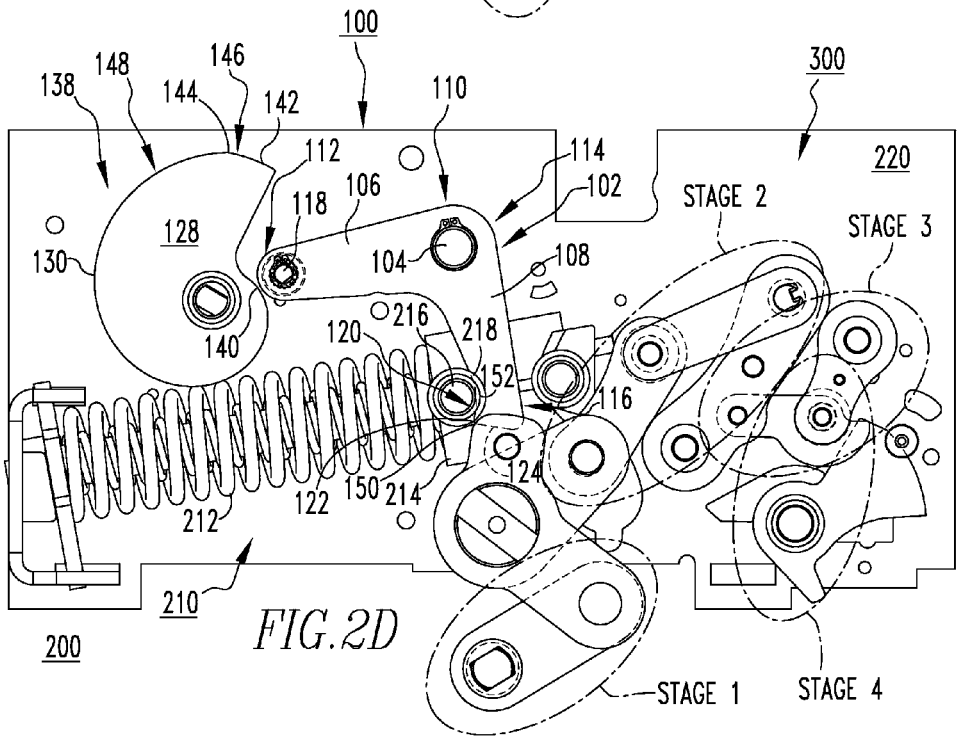
FIG. 2D is a side elevation view of the charging assembly of FIG. 2A, modified to show the charging assembly in the discharged and open position.
Figure 3:
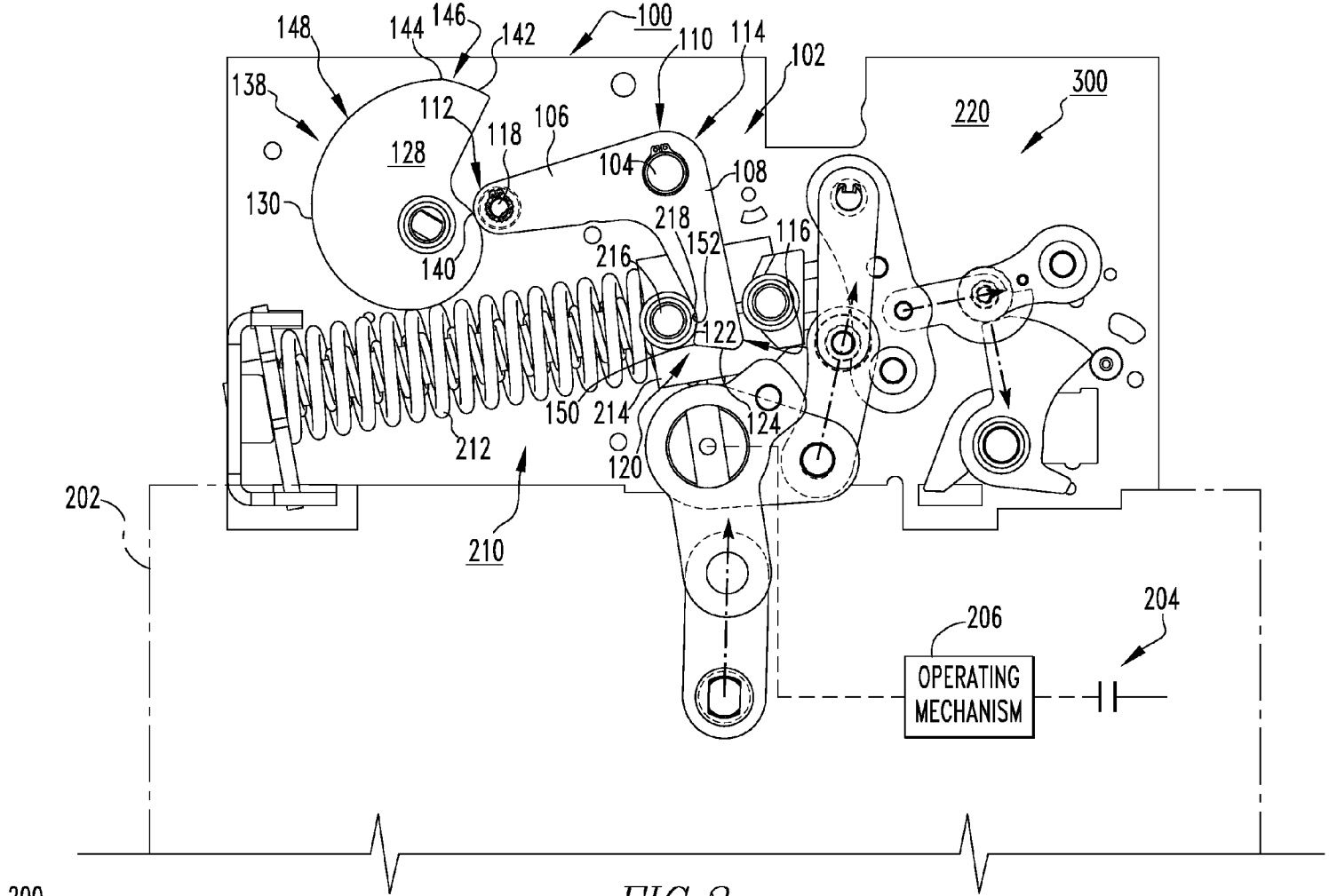
FIG. 3 is a side elevation view of a portion of a circuit breaker employing a charging assembly in accordance with an embodiment of the disclosed concept.

FIGS. 2A-3 show a charging assembly 100 for an electrical switching apparatus such as, for example, a circuit breaker 200 (partially shown in simplified form in phantom line drawing in FIG. 3). As shown in simplified form in FIG. 3, the circuit breaker 200 includes a housing 202 (partially shown in phantom line drawing), separable contacts 204 (shown in simplified form) enclosed by the housing 202, and an operating mechanism 206 (shown in simplified form). The operating mechanism 206 is structured to move the separable contacts 204 between an open position, corresponding to the separable contacts 204 being separated, and a closed position, corresponding to the separable contacts 204 being electrically connected. The operating mechanism 206 includes a linking assembly 300 and the closing assembly 210. The closing assembly 210 includes a biasing element such as, for example and without limitation, the spring 212, which is shown and described herein. However, it will be appreciated that any known or suitable alternative number, type and/or configuration of biasing element(s) could be employed, without departing from the scope of the disclosed concept.

An impact member 214 is coupled to the spring 212, as shown, and is movable, along with the spring 212, between a charged position in which the spring 212 is compressed, as shown in FIG. 2A, and a discharged position in which the spring 212 is extended, as shown in FIGS. 2C and 2D. When the spring 212 moves from the charged position of FIG. 2A to the discharged position, the impact member 214 engages and moves the linking assembly 300 (described in greater detail hereinbelow), as shown in FIG. 2C, thereby moving the separable contacts 204 (FIG. 3) to the aforementioned closed position.

The example charging assembly 100 includes a compression arm 102 pivotally coupled to the housing 202 of the circuit breaker 200 by a pivot 104. More specifically, the compression arm 102 and, in particular, the pivot 104 thereof, is preferably pivotally coupled to a sideplate 220, which is, in turn, coupled to a portion of the circuit breaker housing, as shown in simplified form in FIG. 3. It will, therefore, be appreciated that the circuit breaker may include more than one sideplate (only one sideplate 220 is shown), and that the closing assembly 210 is substantially disposed on a corresponding one of the sideplates 220, as shown.

The compression arm 102 includes a first leg 106 having opposing first and second ends 110,112 and a second leg 108 having opposing first and second legs 114,116. More specifically, the first end 110 of the first leg 106 is disposed at or about the pivot 104 of the compression arm 102, and the second end 112 of the first leg 106 extends outwardly from the pivot 104 in a first direction. Similarly, the first end 114 and the second leg 108 is disposed at or about the pivot 104 of the compression arm 102, and the second end 116 extends outwardly from the pivot 104 in a second direction, which is different from the first direction of first leg 106, as shown. In the example shown and described herein, the first leg includes a first longitudinal axis 132 extending from the pivot 104 of the compression arm 102 through the second end 112 of the first leg 106 in the first direction, and the second leg 108 includes a second longitudinal axis 134 extending from the pivot 104 through the second end 116 of the second leg 108 in the second direction, as shown in FIG. 2A. Preferably, the first longitudinal axis 132 of the first leg 106 is disposed at an angle 136 with respect to the second longitudinal axis 134 of the second leg 108 of between about 80 degrees and about 110 degrees. More preferably, the second leg 108 of the compression arm 102 is disposed generally perpendicularly with respect to the first leg 106, in order that the compression arm 102 has a generally L-shape, as shown. Accordingly, it will be appreciated that the legs 106,108 of the example compression arm 102 are substantially straight as they extend outwardly from the pivot 104 of the compression arm 102, unlike known compression arms (see, for example, compression arm 7 of FIGS. 1A-1D), which are not substantially straight but rather include a number of relatively substantial curves or bends (see, for example, the bend of the first leg of compression arm 7 in FIGS. 1A-1D).

The charging assembly 100 further includes an engagement portion 118 disposed at or about the second end 112 of the first leg 106, and a shaped contact surface 120, which is disposed at or about the second end 114 of the second leg 108. The example shaped contact surface 120 includes a first edge 122 and a second edge 124 disposed in an angle 126 (see FIG. 2B) with respect to the first edge 122. Preferably the angle 126 (FIG. 2B) between the first and second edges 122,124 is less than 90 degrees. The shaped contact surface 120 of the second leg 108 of the example compression arm 102 further includes a convex portion 150 disposed between the first and second edges 122,124 of the shaped contact surface 120, thereby providing a relatively smooth transition between the edges 122,124. The convex portion 150 cooperates with a circular protrusion 216 of the closing assembly impact member 214, which also has a convex exterior 218. Specifically, as the spring 212 of the circuit breaker closing assembly 210 is moved from the discharged position (FIGS. 2C and 2D) to the charged position of FIG. 2A (see also the partially charged position of FIG. 2B), the convex portion 150 of the compression arm shaped contact surface 120 engages the convex exterior 218 of the impact member circular protrusion 216 (e.g., without limitation, pivot pin) to move it and compress (e.g., charge) the spring 212. In other words, the two edges 122,124 of the second leg 108 result in vastly different moment arms (about the pivot 104) for the force of the charging spring(s) 210. See, for example and without limitation, moment arms 160 and 170 of FIGS. 2A and 2B, respectively. The moment arm 170 (FIG. 2B) from the first edge 122 produces much more torque about the pivot 104 and thus higher forces between the first leg 106 and the charging cam 128, than the moment arm 160 (FIG. 2A) second edge 124. Accordingly, the amount of resulting torque that causes the compression arm 102 to rotate becomes much less when the circuit breaker 200 is fully charged (FIG. 2A). As a result of less force being produced, the shape of the charging cam 128 advantageously has less absolute influence on cam shaft torque. The additional benefits of this reduced sensitivity of shape are further described herein. For example and without limitation, force on the cam shaft is reduced which also results in reduced load for the linking assembly 300 (described hereinbelow).

The charging assembly 100 further includes a charging cam 128. Preferably the charging cam 128 is pivotally coupled to the sideplate 220 of the circuit breaker housing 202, proximate to the compression arm 102, as shown. The charging cam 128 includes an outer cam surface 130, which cooperates with the engagement portion 118 of the first leg 106 of the compression arm 102 to facilitate operation of the charging assembly 100, as will now be described in greater detail. Specifically, when the charging cam 128 pivots (e.g., counterclockwise in the direction of the arrows shown in FIGS. 2A and 2B), the outer cam surface 130 engages the engagement portion 118 of the first leg 106 of the compression arm 102, thereby pivoting (e.g., clockwise from the perspective of FIGS. 2A-3) the compression arm 102 about the pivot 104. Responsive to the compression arm 102 pivoting about such pivot 104, the first edge 122 of the shaped contact surface 120 of the second leg 108 engages and moves the impact member 214 of the circuit breaker closing assembly 210, as shown in FIG. 2B. This, in turn, moves the spring 212 of the closing assembly 210 from the discharged position of FIGS. 2C and 2D toward the charged position of FIG. 2A. When the spring 212 is disposed in the charged position, the second edge 124 of the contact surface 120 of the second leg 108 of the compression arm 102, engages the impact member 214, as shown in FIG. 2A.

Accordingly, it will be appreciated that the unique configuration of the shaped contact surface 120 of the compression arm 102, in combination with the improved charging cam 128 (described in greater detail hereinbelow) of the disclosed charging assembly 100, overcomes the disadvantages associated with known charging assemblies (see, for example, charging assembly 1 of FIGS. 1A-1D) by reducing the amount of torque on the compression arm 102. Consequently, wear and tear on the compression arm 102 and charging cam 128 is reduced and the robustness of the charging assembly design is improved. Additionally, the necessity to very closely control the charging cam geometry in an attempt to minimize such excessive torque, is advantageously minimized. As such, the manufacturing cost associated with the charging assembly 100 is reduced.

As best shown in FIG. 2A, the second leg 108 of the example compression arm 102 further includes a concave portion 152. Specifically, the concave portion 152 is disposed on the first edge 122 of the shaped contact surface 120 of the second leg 108, as shown. Accordingly, when the charging cam 128 pivots to initially move the compression arm 102 into engagement with the impact member 214 of the circuit breaker charging assembly 210, the concave portion 152 of the compression arm 102 cooperates with (e.g., engages) the convex exterior 218 of the circular protrusion 216 (e.g., without limitation, pivot pin) of the closing assembly impact member 214, as shown in FIG. 2D.

Referring again to the charging cam 128 of the charging assembly 100, it will be appreciated that the outer cam surface 130 of the charging cam 128 has a variable radius 138. Specifically, the variable radius 138 includes a point of minimum radius 140 and a point of maximum radius 142, wherein the variable radius 138 increases gradually from the point of minimum radius 140 to the point of maximum radius 142. Accordingly, in operation, when the spring 212 of the circuit breaker closing assembly 210 is disposed in the charged position, the point of maximum radius 142 of the charging cam 128 cooperates with (e.g., engages) engagement portion 118 of the first leg 106 of the compression arm 102, as shown in FIG. 2A. Then, when the spring 212 of the closing assembly 210 is disposed in the discharged position, the point of minimum radius 140 on the outer cam surface 130 of the charging cam 128 cooperates with (e.g., engages) the engagement portion 118 of the first leg 106 of the compression arm 102, as shown in FIG. 2C.

The outer cam surface 130 of the charging cam 128 further includes a transition point 144, such that the variable radius 138 has a first downslope 146 disposed between the point of maximum radius 142 and the transition point 144, and a second downslope 148 disposed between the transition point 144 and the point of minimum radius 140. Preferably, the second downslope 148 is greater than the first downslope 146, as shown. In other words, the radius of the outer cam surface 130 decreases more gradually in the area of the first downslope 146, from the point of maximum radius 146 to the transition point 144, whereas the radius of the outer cam surface 130 transitions (e.g., decreases) more rapidly on the opposite side of the transition point 144, in the area of the second downslope 148. Consequently, the operation of the charging assembly 100 and, in particular, the cooperation of the charging cam 128 with the engagement portion 118 of the compression arm 102 is advantageously improved, for example, by controlling the amount of torque between the components 102,128 via the controlled interaction of the cam outer surface 130 with the engagement portion 118 of the compression arm 102 as the spring 212 of the circuit breaker closing assembly 210 is charged.

The aforementioned linking assembly 300 will now be described in greater detail with continued reference to FIGS. 2A-3. It will be appreciated that, while the linking assembly 300 is shown and described herein in conjunction with the aforementioned charging assembly 100, that the disclosed linking assembly 300 could also be employed independently, for example and without limitation, in any known or suitable alternative electrical switching apparatus (not shown) that does not require such an assembly.

The example linking assembly 300 includes a hatchet 302 having first and second edges 304,306 and an arcuate portion 308 extending therebetween. The hatchet 302 is movable between a latched position, shown in FIGS. 2A (shown in solid line drawing), 2C and 3, and an unlatched position, partially shown in phantom line drawing in FIG. 2A (also shown in FIGS. 2B and 2D). More specifically, the hatchet 302 cooperates with a D-shaft 208 that preferably extends outwardly from the aforementioned circuit breaker sideplate 220, and is movable (e.g., pivotable) between a first position and a second position. When the hatchet 302 is disposed in the latched position, the D-shaft 208 is disposed in the first position such that the first edge 304 of the hatchet 302 engages the D-shaft 208, thereby maintaining the hatchet 302 in the position shown in FIGS. 2A (shown in solid line drawing), 2C and 3. When the D-shaft 208 pivots to the second position, for example in response to a fault condition, the D-shaft 208 pivots out of engagement with the first edge 304 of the hatchet 302 such that the hatchet 302 pivots with respect to the D-shaft 208 to unlatch the linking assembly 300, as shown in FIGS. 2B and 2D.

The linking assembly 300 further includes a cradle 310 having first and second opposing ends 312,314 (both shown in FIGS. 2A and 2B) and an intermediate portion 316 (FIGS. 2A and 2B) disposed therebetween. A latch plate 318 is pivotally coupled to the circuit breaker housing 202 and includes a protrusion, which in the example shown and described herein is a roller 320. The roller 320 cooperates with the hatchet 302, as will be described in greater detail hereinbelow. A latch link 322 is disposed between and is pivotally coupled to the cradle 310 and the latch plate 318, as shown. A toggle assembly 324 includes first and second linking elements 326,328. The first and second ends 330,332 of the first linking element 326 are respectively pivotally coupled to the circuit breaker poleshaft 222 and the first end 334 of the second linking element 328, and the second end 336 of the second linking element 328 is pivotally coupled to the cradle 310, as shown in FIGS. 2A, 2B and 3.

Among other benefits, the latch plate 318 and latch link 322 of the disclosed linking assembly 300 provide an additional stage of force reduction that reduces the force(s) associated with tripping the circuit breaker 200 (FIG. 3) open in response to fault conditions. These components (e.g., without limitation, 318,322) also effectively decouple the hatchet 302 and cradle 310 under certain circumstances (described hereinbelow), thereby accommodating a more acceptable movement and configuration among the components (e.g., without limitation, angles between and movement of first and second linking elements 326,328 of toggle assembly 324; degrees of swing or movement of hatchet 302) of the linking assembly 300, as compared with known linking assemblies (see, for example, linking assembly 5 of FIGS. 1A-1D). This, in turn, enables relatively small, or conventional accessories (not shown) to be employed with the circuit breaker 200 (FIG. 3), because the associated tripping forces are advantageously reduced by the linking assembly 300. It also enables the overall size of the circuit breaker 200 (FIG. 3) to be reduced.

As shown, for example, in FIGS. 2A and 2B, the example latch link 322 includes a first portion 338 coupled to the intermediate portion 316 of the cradle 310, and a second portion 340 pivotally coupled to the latch plate 318 at or about the roller 320 thereof. The roller 320 extends outwardly from the latch plate 318 such that, when the hatchet 302 is moved toward the latched position of FIGS. 2A, 2C and 3, the arcuate portion 308 of the hatchet 302 engages the roller 320, thereby moving the latch link 322 with the latch plate 318. In other words, under such circumstances, the latch plate 318 and latch link 322 move collectively together, but not independently with respect to one another. Consequently, responsive to the hatchet 302 and, in particular, the arcuate portion 308 thereof, engaging the roller 320 and moving the latch link 322 with the latch plate 318, movement of the hatchet 302 is transferred substantially directly into movement of the cradle 310. On other hand, when the hatchet 302 is disposed in the unlatched position of FIGS. 2B and 2D, the hatchet 302 disengages the roller 320 such that the latch plate 318 moves with respect to the latch link 322, thereby substantially decoupling movement of the hatchet 302 from movement of the cradle 310. This is a unique design, which is entirely different from known single latch element designs (see, for example, single latch element 23 between hatchet 21 and cradle 25 of linking assembly 5 of FIGS. 1A-1D). Specifically, this decoupling functionality enables sufficient movement of the linking assembly 300 to establish the necessary tripping forces while occupying relatively little space within the circuit breaker housing 202 (partially shown in phantom line drawing in FIG. 3).

Continuing to refer to FIGS. 2A and 2B, it will be appreciated that the latch link 322 includes a first longitudinal axis 342, and the latch plate 318 includes a second longitudinal axis 344. When the hatchet 302 is disposed in the latched position (FIG. 2A), the first longitudinal axis 342 of the latch link 322 is disposed at an angle 346 of about 180 degrees with respect to the second longitudinal axis 344 of the latch plate 318, as shown in FIG. 2A. When the hatchet 302 is disposed in the unlatched position (FIG. 2B), the first longitudinal axis 342 of the latch link 322 is disposed at an angle 346 of between about 90 degrees and about 160 degrees with respect to the second longitudinal axis 344 of the latch plate 318.

Accordingly, it will be appreciated that the hatchet 302, cradle 310, latch plate 318, latch link 322, and toggle assembly 324 of the disclosed linking assembly 300 preferably cooperate to establish at least four stages of force reduction to reduce the aforementioned tripping force which is necessary to trip open the separable contacts 204 (shown in simplified form in FIG. 3), for example, in response to a fault condition. Specifically, as shown in FIGS. 2C and 2D, the non-limiting example linking assembly 300 shown and described herein includes a first stage of force reduction disposed between a drive link 348 and the circuit breaker poleshaft 222, a second stage of force reduction disposed between the poleshaft 222, the first linking element 326 of the toggle assembly 324, the second linking element 328 of the toggle assembly 324, and the cradle 310, a third stage of force reduction disposed between the cradle 310, the latch link 322, and the latch plate 318, and a fourth stage of force reduction disposed between the protrusion (e.g., roller 320) of the latch plate 318 and the hatchet 302. The relative positions of the stages (e.g., stages 1-4) when the linking assembly 300 is disposed in the latched and unlatched positions are labeled and shown in FIGS. 2C and 2D, respectively.

Referring again to FIG. 2A, it will be appreciated that the first linking element 326 of the toggle assembly 324 includes a first longitudinal axis 350, and the second linking element 328 of the toggle assembly 324 includes a second longitudinal axis 352. When the hatchet 302 is latched and the separable contacts 204 (FIG. 3) are disposed in the open position corresponding to FIG. 2A, the first longitudinal axis 350 of the first linking element 326 forms an angle 354 of about 90 degrees with respect to the second longitudinal axis 352 of the second linking element 328. Additionally, as previously discussed, the hatchet 302 of the disclosed linking assembly 300 advantageously moves (e.g., pivots) a relatively small distance compared to the hatchets (see, for example, hatchet 21 of FIGS. 1A-1D) of known linking assembly designs (see, for example, linking assembly 5 of FIGS. 1A-1D). For example, comparing the position of the hatchet 302 shown in solid line drawing in FIG. 2A, corresponding to the latched position, and the position of the hatchet 302 partially shown in phantom line drawing, corresponding to the unlatched position, the hatchet 302 pivots a distance 362, which is preferably less than about 30 degrees. Accordingly, the disclosed hatchet 302 moves (e.g., pivots) substantially less than known hatchets, such as, for example, the hatchet 21 of FIGS. 1A-1D, which pivots in excess of 40 degrees when it moves from the latched position of FIGS. 1A and 1C to the fully unlatched position of FIG. 1D. This reduced hatchet movement allows for a relatively compact linking assembly design which, in turn, enables the overall size of the circuit breaker 200 (FIG. 3) to be advantageously reduced.

Figure 1B:
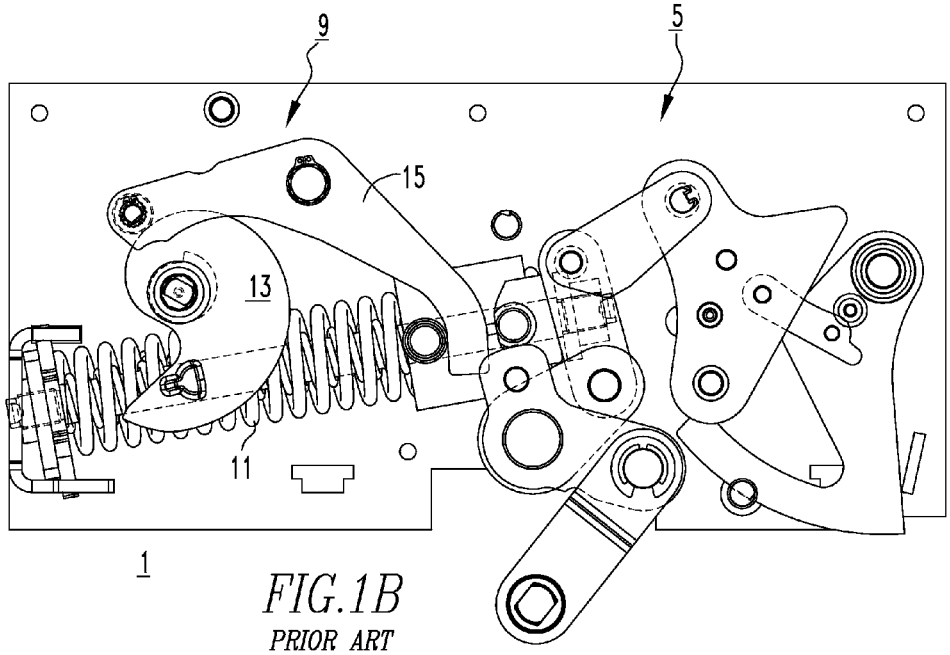
FIG.1B PRIOR ART
FIG. 1B is a side elevation view of the spring charging assembly of FIG. 1A, modified to show the spring charging assembly in the open and partially charged position.
Figure 1C:
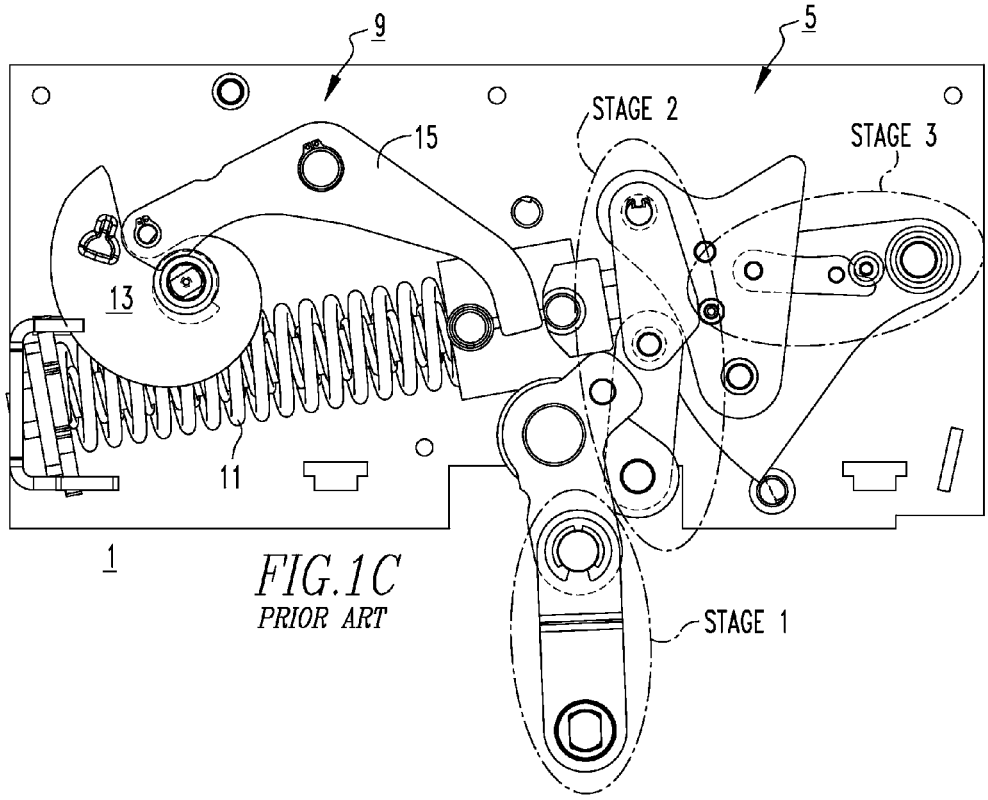
FIG.1C PRIOR ART
FIG. 1C is a side elevation view of the spring charging assembly of FIG. 1A, modified to show the spring charging assembly in the discharged and closed position.
Figure 1D:
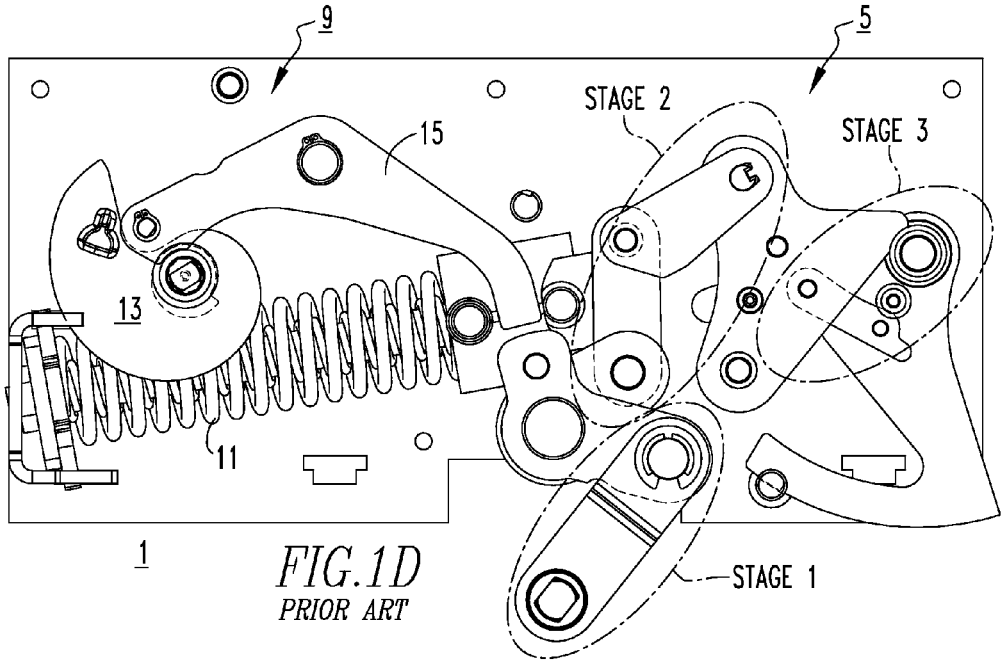
FIG.1D PRIOR ART
FIG. 1D is a side elevation view of the spring charging assembly of FIG. 1A, modified to show the spring charging assembly in the discharged and open position.

The hatchet 302 of the disclosed linking assembly 300 is further distinguishable from prior art designs in that the arcuate portion 308 of the hatchet 302 extends outwardly from the pivot 356 that pivotally couples the hatchet 302 to the housing 202, in a direction that is generally away from the circuit breaker poleshaft 222. In other words, the hatchet 302 extends upwardly (from the perspective of FIGS. 2A-3), which is generally opposite of the configuration of known hatchets (see, for example, hatchet 21 of FIGS. 1A-1D, which extends generally downwardly). Additionally, when the hatchet 302 moves from the latched position of FIGS. 2A, 2C and 3, to the unlatched position of FIGS. 2B and 2D, it pivots clockwise about the pivot 356 in the direction of arrow 360 of FIG. 2A. This is also opposite the direction (e.g., counterclockwise from the perspective of FIGS. 1A-1D) that the hatchet 21 of FIGS. 1A-1D pivots when it moves from the latched position (FIGS. 1A and 1C) to the unlatched position (FIGS. 1B and 1D).

Accordingly, the disclosed linking assembly 300 provides for a relatively compact design that minimizes the relative movement f the components (e.g., hatchet 302; cradle 310; latch plate 318; latch link 322; toggle assembly 324) thereof. This advantageously enables the overall size of the circuit breaker (FIG. 3) to be reduced. Additionally, the linking assembly 300 decouples the hatchet 302 from the cradle 310, when desired, and provides an additional stage of force reduction (e.g., fourth stage of force reduction, shown in FIGS. 2C and 2D) to advantageously reduce the tripping force experienced by the circuit breaker 200 (FIG. 3).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A charging assembly for an electrical switching apparatus, said electrical switching apparatus including a housing, separable contacts enclosed by the housing, and an operating mechanism structured to move said separable contacts between an open position corresponding to said separable contacts being separated and a closed position corresponding to said separable contacts being electrically connected, said operating mechanism including a linking assembly and a closing assembly, said closing assembly including a biasing element and an impact member coupled to said biasing element, said biasing element being movable between a charged position and a discharged position, when said biasing element moves from said charged position to said discharged position, said impact member engages and moves said linking assembly thereby moving said separable contacts to said closed position, said charging assembly comprising:

a compression arm including a pivot structured to pivotally couple said compression arm to the housing of said electrical switching apparatus, a first leg, and a second leg, each of said first leg and said second leg comprising a first end and a second end disposed opposite and distal from the first end, the first end of said first leg being disposed at or about said pivot, the second end of said first leg extending outwardly from said pivot in a first direction, the first end of said second leg being disposed at or about said pivot, the second end of said second leg extending outwardly from said pivot in a second direction;

an engagement portion disposed at or about the second end of said first leg;

a shaped contact surface disposed at or about the second end of said second leg, said shaped contact surface comprising a first edge and second edge disposed at an angle with respect to the first edge; and a charging cam structured to be pivotally coupled to the housing of said electrical switching apparatus, said charging cam including an outer cam surface structured to cooperate with said engagement portion of said first leg of said compression arm, wherein, when said charging cam pivots, the outer cam surface engages said engagement portion of said first leg, thereby pivoting said compression arm about said pivot, wherein, responsive to said compression arm pivoting about said pivot, the first edge of said shaped contact surface of said second leg is structured to engage and move said impact member of said closing assembly, thereby moving said biasing element from said discharged position toward said charged position, and wherein, when said biasing element is disposed in said charged position, the second edge of said shaped contact surface of said second leg is structured to engage said impact member.

2. The charging assembly of claim 1 wherein said first leg further comprises a first longitudinal axis extending from said pivot of said compression arm through the second end of said first leg in said first direction; wherein said second leg further comprises a second longitudinal axis extending from said pivot of said compression arm through the second end of said second leg in said second direction; wherein said first longitudinal axis is disposed at an angle with respect to said second longitudinal axis; and wherein said angle is between about 80 degrees and about 110 degrees.

3. The charging assembly of claim 2 wherein said second leg of said compression arm is disposed generally perpendicularly with respect to said first leg of said compression arm in order that said compression arm has a generally L-shape.

4. The charging assembly of claim 1 wherein the outer cam surface of said charging cam comprises a variable radius; wherein said variable radius comprises a point of minimum radius and a point of maximum radius; wherein said variable radius increases gradually from the point of minimum radius to the point of maximum radius; wherein, when said biasing element is disposed in said charged position, the point of maximum radius of said charging cam is structured to be cooperable with said engagement portion of said first leg; and wherein, when said biasing element of said closing assembly is disposed in said discharged position, the point of minimum radius of said charging cam is structured to cooperate with said engagement portion of said first leg of said compression arm.

5. The charging assembly of claim 4 wherein the outer cam surface of said charging cam further comprises a transition point; wherein the variable radius further comprises a first downslope and a second downslope; wherein the first downslope is disposed between the point of maximum radius and the transition point; and wherein the second downslope is disposed between the transition point and the point of minimum radius.

6. The charging assembly of claim 5 wherein the second downslope is greater than the first downslope.

7. The charging assembly of claim 1 wherein said shaped contact surface of said second leg of said compression arm further comprises a convex portion disposed between the first edge of said shaped contact surface and the second edge of said shaped contact surface; and wherein said angle between the first edge and the second edge is less than 90 degrees.

8. The charging assembly of claim 7 wherein said impact member of said closing assembly includes circular protrusion having a convex exterior; and wherein, when said biasing element is moved from said discharged position to said charged position, said convex portion of said shaped contact surface is structured to cooperate with the convex exterior of said circular protrusion.

9. The charging assembly of claim 8 wherein said second leg of said compression arm further comprises a concave portion; wherein said concave portion is disposed on the first edge of said shaped contact surface of said second leg; and wherein, when said charging cam pivots to initially move said compression arm into engagement with said impact member of said closing assembly, said concave portion of said compression arm is structured to cooperate with the convex exterior of said circular protrusion of said impact member.

10. An electrical switching apparatus comprising:

a housing;

separable contacts enclosed by the housing;

an operating mechanism structured to move said separable contacts between an open position corresponding to said separable contacts being separated and a closed position corresponding to said separable contacts being electrically connected;

a linking assembly;

a closing assembly including a biasing element and an impact member coupled to said biasing element, said biasing element being movable between a charged position and a discharged position, when said biasing element moves from said charged position to said discharged position, said impact member engages and moves said linking assembly thereby moving said separable contacts to said closed position; and a charging assembly comprising:

a compression arm including a pivot pivotally coupling said compression arm to the housing, a first leg, and a second leg, each of said first leg and said second leg comprising a first end and a second end disposed opposite and distal from the first end, the first end of said first leg being disposed at or about said pivot, the second end of said first leg extending outwardly from said pivot in a first direction, the first end of said second leg being disposed at or about said pivot, the second end of said second leg extending outwardly from said pivot in a second direction, an engagement portion disposed at or about the second end of said first leg, a shaped contact surface disposed at or about the second end of said second leg, said shaped contact surface comprising a first edge and second edge disposed at an angle with respect to the first edge, and a charging cam pivotally coupled to the housing of said electrical switching apparatus, said charging cam including an outer cam surface cooperating with said engagement portion of said first leg of said compression arm, wherein, when said charging cam pivots, the outer cam surface engages said engagement portion of said first leg, thereby pivoting said compression arm about said pivot, wherein, responsive to said compression arm pivoting about said pivot, the first edge of said shaped contact surface of said second leg engages and moves said impact member of said closing assembly, thereby moving said biasing element from said discharged position toward said charged position, and wherein, when said biasing element is disposed in said charged position, the second edge of said shaped contact surface of said second leg engages said impact member.

11. The electrical switching apparatus of claim 10 wherein said first leg of said compression arm of said charging assembly further comprises a first longitudinal axis extending from said pivot of said compression arm through the second end of said first leg in said first direction; wherein said second leg further comprises a second longitudinal axis extending from said pivot of said compression arm through the second end of said second leg in said second direction; wherein said first longitudinal axis is disposed at an angle with respect to said second longitudinal axis; and wherein said angle is between about 80 degrees and about 110 degrees.

12. The electrical switching apparatus of claim 11 wherein said second leg of said compression arm is disposed generally perpendicularly with respect to said first leg of said compression arm in order that said compression arm has a generally L-shape.

13. The electrical switching apparatus of claim 10 wherein the outer cam surface of said charging cam of said charging assembly comprises a variable radius; wherein said variable radius comprises a point of minimum radius and a point of maximum radius; wherein the variable radius increases gradually from the point of minimum radius to the point of maximum radius; wherein, when said biasing element is disposed in said charged position, the point of maximum radius of said charging cam cooperates with said engagement portion of said first leg; and wherein, when said biasing element of said closing assembly is disposed in said discharged position, the point of minimum radius of said charging cam cooperates with said engagement portion of said first leg of said compression arm.

14. The electrical switching apparatus of claim 13 wherein the outer cam surface of said charging cam further comprises a transition point; wherein the variable radius further comprises a first downslope and a second downslope; wherein the first downslope is disposed between the point of maximum radius and the transition point; and wherein the second downslope is disposed between the transition point and the point of minimum radius.

15. The electrical switching apparatus of claim 14 wherein the second downslope is greater than the first downslope.

16. The electrical switching apparatus of claim 10 wherein said shaped contact surface of said second leg of said compression arm of said charging assembly further comprises a convex portion disposed between the first edge of said shaped contact surface and the second edge of said shaped contact surface; and wherein said angle between the first edge and the second edge is less than 90 degrees.

17. The electrical switching apparatus of claim 16 wherein said impact member of said closing assembly includes circular protrusion having a convex exterior; and wherein, when said biasing element is moved from said discharged position to said charged position, said convex portion of said shaped contact surface cooperates with the convex exterior of said circular protrusion.

18. The electrical switching apparatus of claim 17 wherein said second leg of said compression arm of said charging assembly further comprises a concave portion; wherein said concave portion is disposed on the first edge of said shaped contact surface of said second leg; and wherein, when said charging cam pivots to initially move said compression arm into engagement with said impact member of said closing assembly, said concave portion of said compression arm cooperates with the convex exterior of said circular protrusion of said impact member.

19. The electrical switching apparatus of claim 10 wherein said biasing element of said closing assembly is at least one spring; wherein, when said at least one spring is disposed in said charged position, said at least one spring is compressed; wherein, when said at least one spring is disposed in said discharged position, said at least one spring is extended; and wherein said at least one spring biases said impact member of said closing assembly toward engagement with said linking assembly.

20. The electrical switching apparatus of claim 10 wherein said electrical switching apparatus is a circuit breaker; wherein the housing of said circuit breaker includes a number of sideplates; wherein said closing assembly is substantially disposed on a corresponding one of said sideplates; and wherein said charging cam of said charging assembly and said pivot of said compression arm of said charging assembly are pivotally coupled to said corresponding one of said sideplates.

* * * * *